US005845571A

United States Patent [19]

Kurashige et al.

[11] Patent Number: 5,845,571

[45] Date of Patent: Dec. 8, 1998

[54] METHOD AND APPARATUS FOR PREVENTING INK BLURRING IN A STENCIL PRINTER

[75] Inventors: Michio Kurashige, 3-23-3, Kitamatsuzono, Morioka-shi, Iwate-ken; Hironobu Takasawa, Sendai; Tomiya Mori, Kakuda, all of Japan

[73] Assignees: Michio Kurashige, Morioka; Tohoku Ricoh Co., Ltd., Miyagi-ken, both of Japan

[21] Appl. No.: 789,179

[22] Filed: Jan. 24, 1997

Related U.S. Application Data

[63] Continuation of Ser. No. 421,967, Apr. 14, 1995, abandoned.

[30] Foreign Application Priority Data

Jun. 29, 1994 [JP] Japan ..... 6-147708
Jan. 24, 1995 [JP] Japan ..... 7-009148

[51] Int. Cl.[6] ..... B41L 13/04; B41F 13/18

[52] U.S. Cl. ..... 101/120; 101/118

[58] Field of Search ..... 101/116, 117, 101/118, 119, 120

[56] References Cited

U.S. PATENT DOCUMENTS

| | | | |
|---|---|---|---|
| 3,807,302 | 4/1974 | Kudlich | 101/119 |
| 4,911,069 | 3/1990 | Hayama et al. | 101/120 |
| 5,243,904 | 9/1993 | Hayama et al. | 101/120 |

FOREIGN PATENT DOCUMENTS

| | | | |
|---|---|---|---|
| 69086 | 4/1983 | Japan | 101/119 |
| 232865 | 12/1984 | Japan | 101/120 |
| 59-218889 | 12/1984 | Japan . | |
| 188180 | 8/1986 | Japan | 101/120 |
| 1-204781 | 8/1989 | Japan . | |
| 4-17153 | 3/1992 | Japan . | |
| 4-113879 | 4/1992 | Japan . | |
| 5-162430 | 6/1993 | Japan . | |

*Primary Examiner*—Stephen R. Funk
*Attorney, Agent, or Firm*—Oblon, Spivak, McClelland, Maier & Neustadt, P.C.

[57] ABSTRACT

A method of printing a document image on a paper by wrapping a stencil, or master, perforated by, for example, a thermal head around a print drum, and a stencil printer. A wedge effect occurs between the print drum and an ink roller disposed in the print drum. The wedge effect, coupled with the pressure of a pressing member, causes ink to exude from the inner periphery to the outer periphery of the print drum and further from the master to the paper. The paper is separated from the master at a position downstream, with respect to the direction of rotation of the print drum, of a portion where the ink exudes due to the wedge effect. At the paper separating position, the ink does not exude from the master, and the ink pressure does not act. This obviates the blur of a printed image and prevents the ink from being transferred from the front of an underlying printing sheet to the rear of an overlying printing sheet stacked on the underlying sheet due to excessive ink transfer.

9 Claims, 12 Drawing Sheets

$$P = \frac{6\sqrt{2Rh_0}\,U\eta_0}{h_0^2}\,\bar{P}(\bar{X}), \quad \bar{X} = \frac{X}{\sqrt{2Rh_0}}$$

METHOD AND APPARATUS FOR PREVENTING INK BLURRING IN A STENCIL PRINTER

This application is a continuation of application Ser. No. 08/421,967, filed on Apr. 14, 1995, now abandoned.

BACKGROUND OF THE INVENTION

The present invention relates to a method of printing a document image on a paper by wrapping a stencil, or master, having a perforation pattern representative of the document image and formed by, for example, a thermal head around a print drum, and a stencil printer.

A method of forming an image on a paper by supplying ink to one side of a master formed with a perforation pattern representative of a document image, and causing the ink to penetrate the perforation pattern to thereby transfer it to the paper is conventional. Typical of a printer using this kind of method is a mimeograph. Various kinds of printers, including a digital stencil printer, available today are also implemented by the above printing scheme. A digital stencil printer, for example, includes a print drum made up of a cylindrical porous support layer and a porous elastic layer which serves as an ink holding layer. An ink supply device is disposed in the print drum and includes an ink roller for supplying ink to the inner periphery of the print drum, and a doctor roller for regulating the amount of ink. A press roller presses a paper against the outer periphery of the print drum with the intermediary of the master. After the master has been wrapped around the print drum, the ink from the ink supply device is passed through the laminate print drum to the master. As a result, the ink is transferred from the master to the paper pressed against the master by the press roller. More specifically, the ink is compressed by an elastohydrodynamic lubrication effect or a so-called wedge effect acting between the ink roller and the inner periphery of the porous support layer. Consequently, the ink is supplied to the support layer and elastic layer. The ink exudes from the perforated portion of the master to print an image on the paper.

The digital stencil printer usually uses oil ink or water-in-oil type emulsion ink (water surrounded by oil) which is sparingly evaporable. This is to prevent a great amount of papers from being wasted when the printer is operated after a long time of suspension or when printing is resumed after an interruption. Because ink of the type mentioned is sparingly evaporable, a certain period of time is necessary for the ink to penetrate the fibers of a paper and then dry.

On the other hand, when a paper begins to be separated from the portion of the master where the ink is exuding due to the wedge effect, the ink is transferred to the paper in a great amount. As such papers each carrying a great amount of ink thereon are sequentially stacked on a tray, the ink is undesirably transferred from the front of the underlying paper to the rear of the overlying paper, thereby smearing the latter. Moreover, when the paper is pressed against a portion where the ink has oozed out from the master due to the wedge effect, it crushes the ink. As a result, the ink penetrates the fibers of the paper and thereby blurs the resulting image.

SUMMARY OF THE INVENTION

It is, therefore, an object of the present invention to provide a stencil printing method and a stencil printer which obviate the blur of an image and prevents ink from being transferred from the front of the underlying printing to the rear of the overlying printing.

In accordance with the present invention, a method of printing a document image on a paper by causing ink to exude through a master having a perforation pattern which is representative of the document image has the steps of wrapping the master around the outer periphery of a print drum, supplying the ink to the inner periphery of the print drum by an ink roller, pressing the paper against the master by a pressing member, transferring the ink to the paper by causing the ink to exude from the master due to a wedge effect which occurs between the ink roller and the inner periphery of the print drum, and separating the paper from the master at a position downstream, with respect to the direction of rotation of the print drum, of a portion where the ink exudes from the master due to the wedge effect.

Also, in accordance with the present invention, a stencil printer for printing a document image on a paper by causing ink to exude through a master having a perforation pattern which is representative of the document image includes a print drum for wrapping the master around the outer periphery thereof. An ink roller supplies the ink to the inner periphery of the print drum. A pressing member presses the paper against the master. The ink is transferred to the paper by being caused to exude from the master due to a wedge effect which occurs between the ink roller and the inner periphery of the print drum. A separating member separates the paper, carrying the ink thereon, from the master. The separating means is positioned downstream, with respect to the direction of rotation of the print drum, of a portion where the ink exudes from the master due to the wedge effect. A position for separating the paper from the master is located downstream of the above-mentioned portion with respect to the same direction.

Further, in accordance with the present invention, a stencil printer of the type described has a print drum for wrapping the master around the outer periphery thereof includes an ink roller for supplying the ink to the inner periphery of the print drum, and a pressing member for pressing the paper against the master. The ink is transferred to the paper by being caused to exude from the master due to a wedge effect which occurs between the ink roller and the inner periphery of the print drum. The pressing member is positioned such that the downstream end of the pressing range of the pressing member with respect to the direction of rotation of the print drum is located downstream, with respect to the same direction, of a portion where the ink exudes from the master due to the wedge effect.

Moreover, in accordance with the present invention a stencil printer of the type descibed includes a print drum for wrapping the master around the outer periphery thereof, an ink roller for supplying the ink to the inner periphery of the print drum, and a pressing member for pressing the paper against the master. The ink is transferred to the paper by being caused to exude from the master due to a wedge effect which occurs between the ink roller and the inner periphery of the print drum. The pressing member is positioned such that the upstream end of the pressing range of the pressing member with respect to the direction of rotation of the print drum is located upstream, with respect to the same direction, of a portion where the ink exudes from the master due to the wedge effect.

In addition, in accordance with the present invention, a stencil printer of the type described has a print drum for wrapping the master around the outer periphery thereof, an ink roller for supplying the ink to the inner periphery of the print drum, and a pressing member for pressing the paper against the master. The ink is transferred to the paper by being caused to exude from the master due to a wedge effect which occurs between the ink roller and the inner periphery of the print drum. The pressing member is positioned such that a portion where the ink exudes from the master due to the wedge effect is contained in the pressing range of the pressing member.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
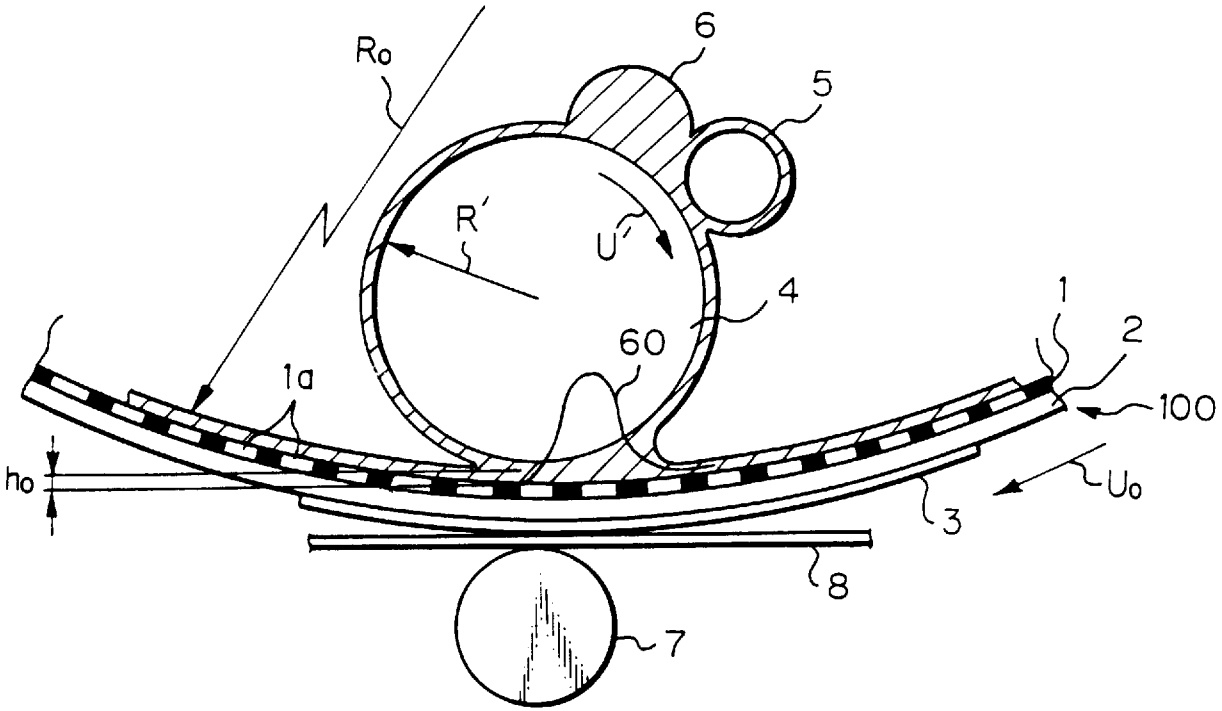
Fig. 1 PRIOR ART
FIG. 1 is a section of a conventional stencil printer.

To better understand the present invention, a reference will be made to a conventional digital stencil printer, shown in FIG. 1 As shown, the printer has a hollow print drum 100 made up of a porous support layer 1 and a porous elastic layer 2 serving as an ink holding layer, surrounding the support layer 1. A press roller, or pressing member, 7 is located in close proximity to the outer periphery of the drum 100. After a perforated stencil, or master 3, has been wrapped around the drum 100, an ink supply device disposed in the drum 100 supplies ink to the inner periphery of the drum 100. The press roller 7 presses a paper 8 against the print drum 100 via the master 3.

The ink supply device includes an ink roller 4 for supplying the ink to the inner periphery of the drum 100. A doctor roller 5 is spaced apart from the ink roller 4 by a predetermined gap and forms an ink well 6 between it and the roller 4. The ink is measured at the gap between the ink roller 4 and the doctor roller 5 and then fed to the inner periphery of the drum 100. A gap $h_0$ is formed between the support layer 1 of the drum 100 and the ink roller 4 and filled with the ink.

The porous support layer 1 is a hollow cylindrical member implemented by a thin sheet of stainless steel or iron, or a thin sheet of nickel which is produced by electroforming. Part of the cylindrical member 1 constituting an image area is formed with a great number of micropores for the penetration of the ink. The elastic layer 2 is usually comprised of a screen mesh of stainless steel or similar metal fibers or of nylon, polyester or similar chemical fibers. In the illustrative embodiment, at least one layer of sponge rubber having continuous bubbles, felt, unwoven cloth of chemical fibers or metal fibers, polyvinyl acetal- or polyvinyl alcohol-based porous elastic substance having continuous bubbles, porous elastic substance consisting of hard grains and rubber and having continuous bubbles, porous elastic substance produced by sintering fine powder of polyethylene or similar synthetic resin, metal or inorganic substance, or porous elastic substance produced by fluid-sintering polyurethane or similar substance may be formed on the outer periphery of the support layer 1 as the elastic layer 2.

While the diameter and pitch of the micropores of the support layer 1 should preferably be as small as possible, they are limited in relation to the mechanical strength and production cost of the support layer 1. In practice, therefore, the diameter and pitch of the micropores of the support layer 1 are greater than those of the micropores of the elastic layer 2. The elastic layer 2 serves to uniformly scatter the ink coming out of the support layer 1, so that the printed image may be free from irregularity.

The press roller 7 is rotatable and movable into and out of contact with the drum 100. A press drum, not shown, is another specific form of the pressing member known in the art. The press drum has the same diameter as the drum 100 and rotates in synchronism with the drum 100. The press roller 7 is made of rubber and smaller in diameter than the drum 100.

The stencil 3 has a laminate structure made up of a porous substrate and a film of thermoplastic resin adhered to the substrate. The porous substrate is implemented by a porous thin sheet of kozo, mitsumata, Manila hemp, flax or similar natural fibers, unwoven cloth of rayon, VINYLON™, polyester or similar chemical fibers, or unwoven cloth of natural fibers and chemical fibers. For the film of thermoplastic resin, use may be made of polyester-based resin. Recently in study is a stencil implemented substantially only by a thermoplastic resin film, i.e., a thin rolled polyester film and not having the porous substrate. In this case, a layer of antistatic agent and/or a layer of anti-stick agent is formed on the film. The anti-stick agent prevents the stencil from sticking to a thermal head. Because this kind of master lacks the porous substrate, the selection of the porous elastic layer, or outermost layer, of the print drum 100 is important.

In the stencil printer shown in FIG. 1, the ink is pressed between the ink roller 4 and the support layer 1 of the drum 100 due to the previously mentioned wedge effect. As a result, the ink exudes to the elastic layer 2 via the micropores of the support layer 1. The wedge effect is derived from an elastohydrodynamic lubrication theory. The wedge effect refers to an occurrence that when two inclined surfaces move while sequentially reducing the gap therebetween, a fluid filling the gap is pressed and generates a pressure high enough to support the two surfaces. In FIG. 1, a curve 60 is representative of a pressure distribution generated by the ink between the support layer 1 and the ink roller 4 due to the wedge effect.

The wedge effect will be described more specifically hereinafter. The pressure distribution 60, FIG. 1, derived from the wedge effect can be determined by solving the one dimensional Reynolds equation. Assume that the support layer 1 and ink roller 4 have radii $R_0$ and R', respectively, and rotate in contact with each other at peripheral speeds $U_0$ and U', respectively. Further, to determine the pressure distribution 60, assume an equivalent cylinder having a radius R and a rotation speed U defined by the following equation (see FIG. 2). Specifically, R and U may be expressed as:

$$R=1/(1/R'-1/R_0),\ U=U'+U_0 \qquad \text{Eq.(1)}$$

By using the SS condition (Reynolds exit condition) which is a more realistic ink exit condition, the pressure distribution of the ink is given as follows. In the following equations, "x" is equivalent to a condition wherein the origin is located at the point where a line connecting the center of rotation of the support layer and that of the ink roller and the inner periphery of the layer intersect each other, and the direction of rotation of the layer is the positive direction.

$$\bar{p}(\bar{x}) = -\frac{(1+c_0^2)\bar{x}}{4(1+\bar{x}^2)^2} + \frac{1-3c_0^2}{8}\left\{\frac{\bar{x}}{1+\bar{x}^2} + \tan^{-1}(\bar{x}) + \frac{\pi}{2}\right\} \qquad \text{Eq. (2)}$$

Here, the dimensionless coordinate $\bar{X}$ and dimensionless pressure $\bar{P}$ are defined by:

$$\bar{x} = \frac{x}{\sqrt{2Rh_0}} = c_0\frac{x}{x_0} \quad (c_0 = 0.4754) \qquad \text{Eq. (3)}$$

$$\bar{p} = \frac{h_0^2 p}{6\sqrt{2Rh_0}\ U\eta_0} = c_1\frac{p}{p_m} \quad (c_1 = 0.1267) \qquad \text{Eq. (4)}$$

From the Eqs. (2) and (4), $$p = \frac{p_m}{c_1}\bar{p}(\bar{x}) = \frac{6\sqrt{2Rh_0}\ U\eta_0}{h_0^2}\bar{p}(\bar{x}) \qquad \text{Eq. (5)}$$

Figure 2:
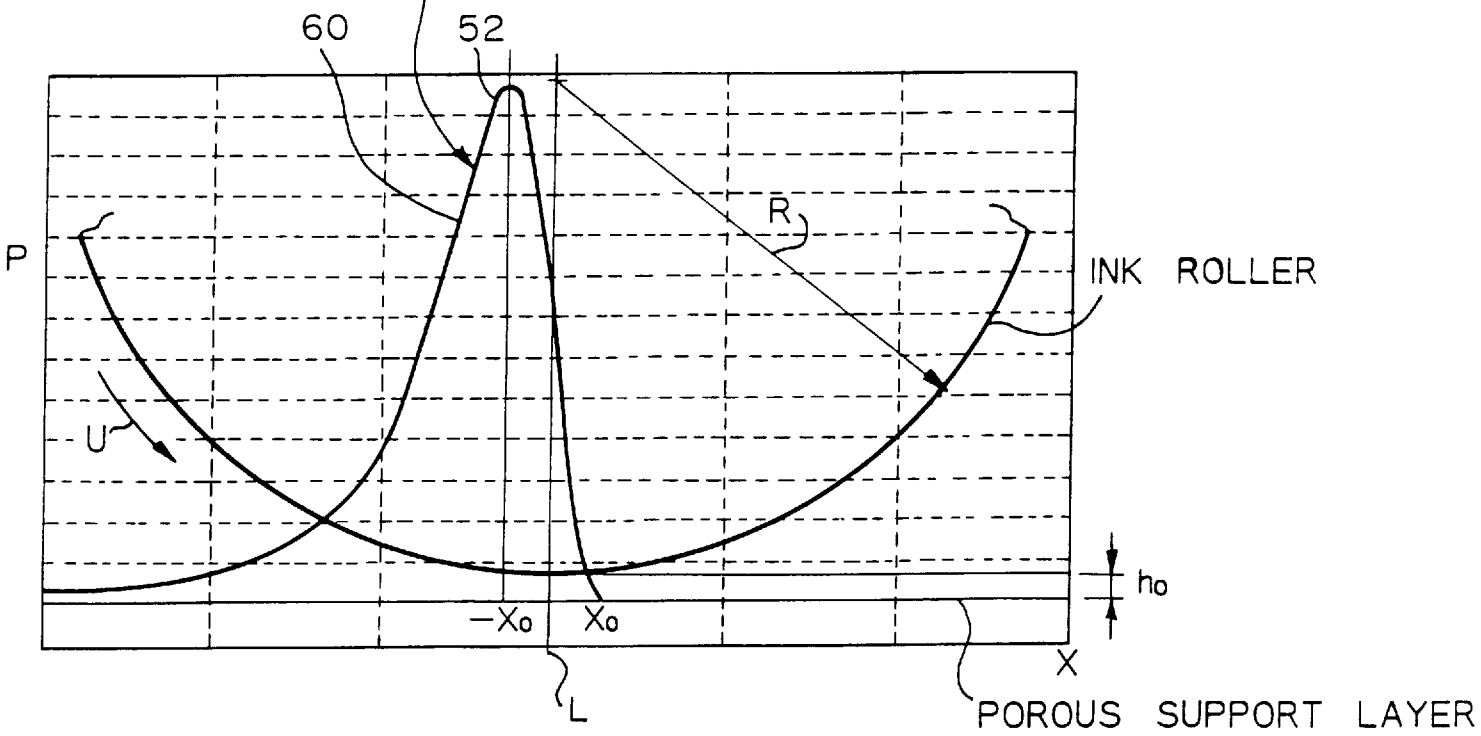
Fig. 2 (PRIOR ART)
FIG. 2 is a graph showing an ink pressure distribution derived from the wedge effect.

The Eq. (5) is representative of the pressure distribution 60 attainable with the wedge effect (see FIG. 2). In FIG. 2, a value $X_0$ is equivalent to a deviation of the peak 52 of the ink pressure from a line 1, connecting the center of rotation of the support layer and that of the ink roller to the upstream side with respect to the direction of rotation of the ink roller. Also shown in FIG. 2 are the maximum pressure $p_m$ of the ink, the viscosity $\eta_0$ of the ink, and the gap $h_0$ between the ink roller and the support layer.

The above analysis has concentrated on a printer whose print drum has a porous support layer. However, it is also true with a printer of the type having an ink roller and a porous elastic layer directly contacting each other via ink, i.e., without the intermediary of a porous support layer, as taught in Japanese Patent Laid-Open Publication No. 1-204781 and corresponding U.S. Pat. No. 4,911,069.

The conventional printer described above has some problems yet to be solved, as follows. When the paper 8 begins to be separated from the portion of the master 3 where the ink is exuding due to the wedge effect, the ink is transferred to the paper 8 in a great amount. As such papers each carrying a great amount of ink thereon are sequentially stacked on a tray, the ink is undesirably transferred from the front of the underlying paper to the rear of the overlying paper.

Figure 3:
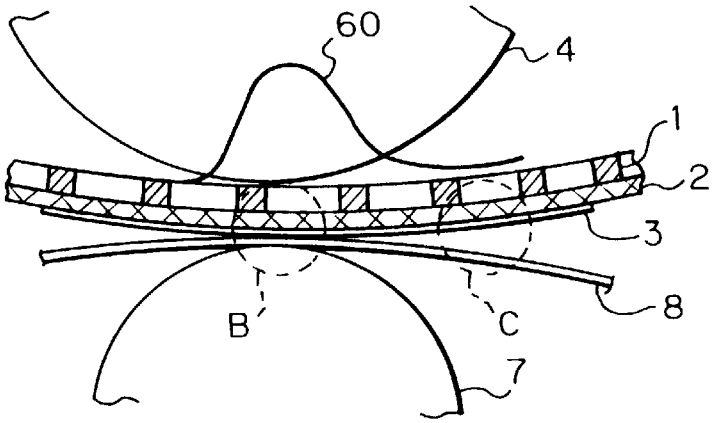
Fig. 3 (PRIOR ART)
FIG. 3 demonstrates the blur of an image caused by the conventional printer.
Figure 4:
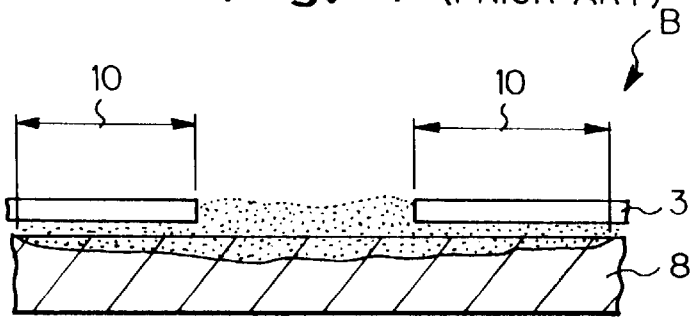
Fig. 4 (PRIOR ART)
FIG. 4 is an enlarged section of a portion B shown in FIG. 3.
Figure 5:
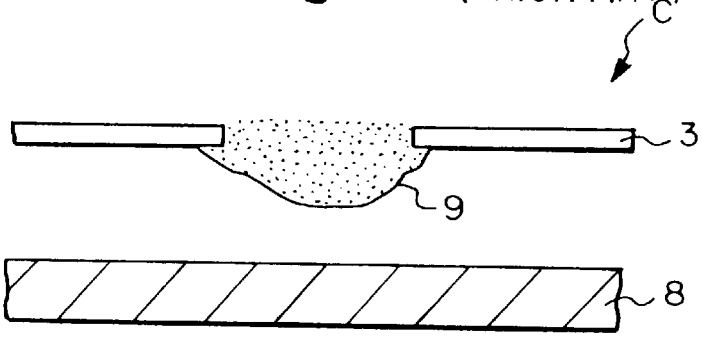
Fig. 5 (PRIOR ART)
FIG. 5 is an enlarged section of a portion C also shown in FIG. 3.

Moreover, as shown in FIGS. 3–5, when the paper 8 is pressed against a portion 9 (see FIG. 5) where the ink has exuded from the master 3 due to the wedge effect, it crushes the ink. As a result, as shown in FIG. 4, the ink penetrates the fibers of the paper 8 and thereby blurs the resulting image, as at 10.

Preferred embodiments of the stencil printer in accordance with the present invention will be described which are free from the problems discussed above.

Figure 6:
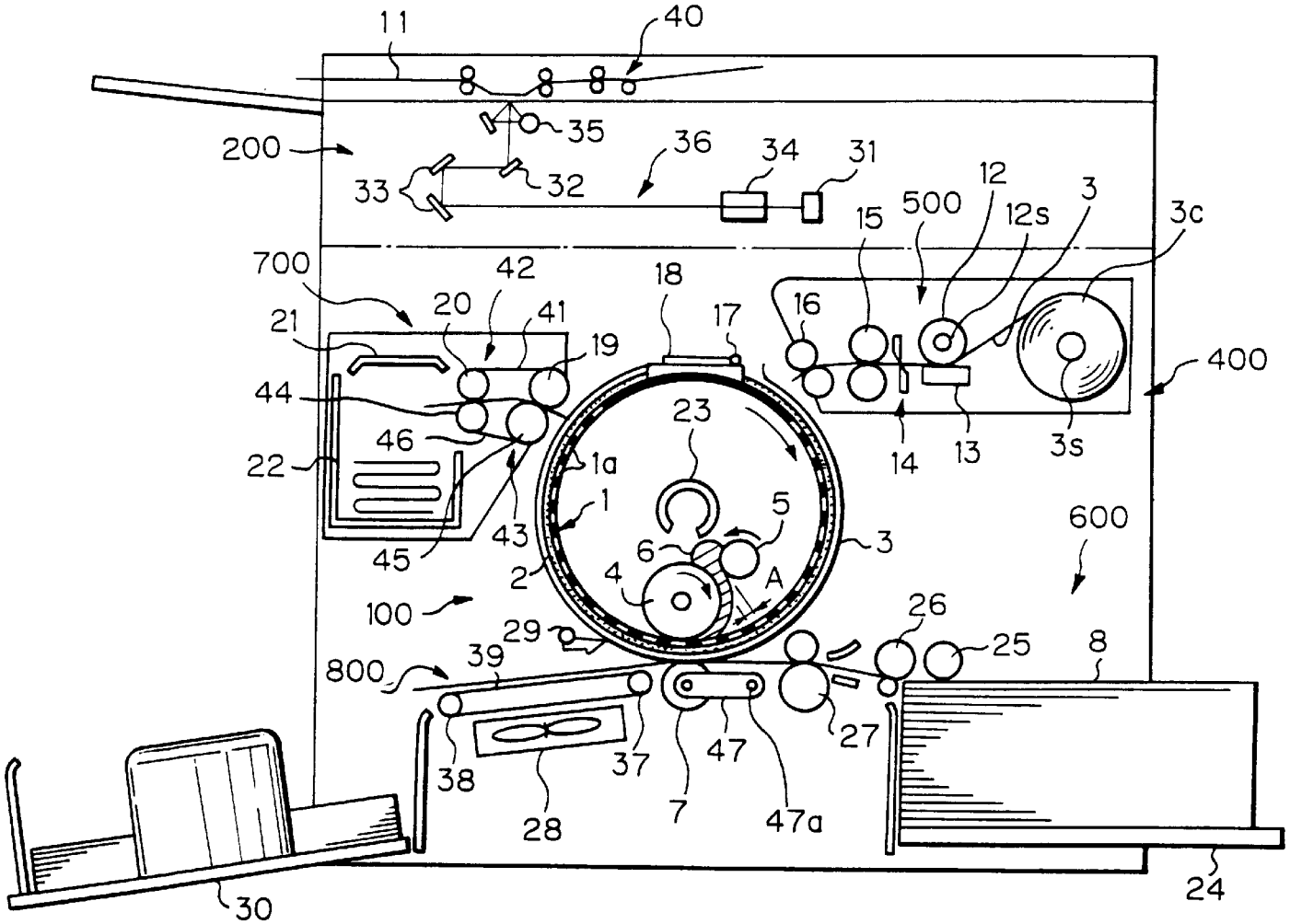
FIG. 6 is a section showing a first embodiment of the stencil printer in accordance with the present invention.

Referring to FIG. 6, a first embodiment of the present invention is shown. As shown, a stencil printer includes an image forming section 400. A print drum 100 is positioned substantially at the center of the image forming section 400. A master making device 500 is located above and at the right-hand side of the drum 100. A paper feeding device 600 is located below and at the right-hand side of the drum 100. A master discharging device 700 is located above and at the left-hand side of the drum 100. A paper discharging device 800 is located below and at the left-hand side of the drum 100. A press roller, or pressing member, 7 is located below the drum 100. A document reading section 200 is positioned above the image forming section 400. The reference numeral 29 designates a paper separator or separating means.

The document reading section 200 includes an automatic document feeder (ADF) for conveying a document 11 from a stacking position to a reading position. A mirror 32 is positioned below the ADF 40 for reflecting a reflection from the document 11. A pair of mirrors 33 are movable at a speed which is one half of the moving speed of the mirror 32. The reference numeral 34 designates a lens. Light representative of the document image and passed through the lens 34 is incident to a CCD (Charge Coupled Device) image sensor 31 and converted to an image signal thereby. A fluorescent lamp 35 illuminates the surface of the document 11. The mirrors 32, 33, lens 34, CCD image sensor 31 and lamp 35 constitute optics 36 for scanning the document 11.

The drum 100 has a porous support layer 1 and a porous elastic layer 2 on the inner periphery and outer periphery, respectively. The elastic layer 2 surrounds the support layer 1 and plays the role of an ink retaining layer. The drum 100 is rotatably mounted on an ink supply shaft 23 and driven by a motor, not shown. Clamping means is mounted on the outer periphery of the drum 100 in order to clamp a master 3.

Figure 7:
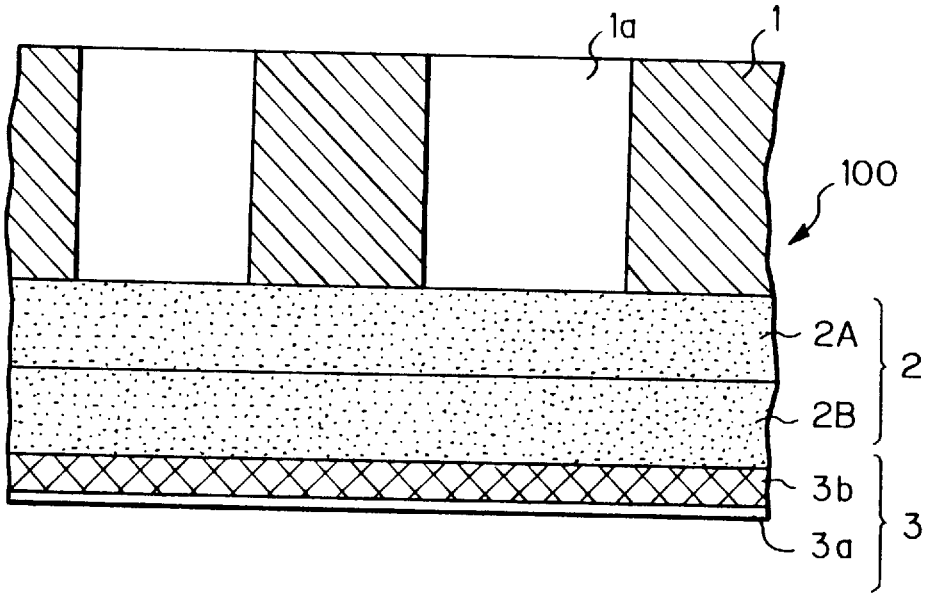
FIG. 7 is an enlarged section of a print drum and a master included in the first embodiment.

The porous support layer 1 is implemented as a hollow cylinder made of stainless steel or similar metal. As shown in FIG. 7, a great number of micropores 1*a* are formed in the hollow cylinder 1 except for a portion where the clamp means is located and peripheral portions thereof, i.e., in an image area thereof. The porous elastic layer 2 is comprised of a screen mesh of TETRON™, nylon, polyester or similar chemical fibers or stainless steel or similar metal fibers intersecting in a mesh configuration. The screen mesh includes a great number of open areas for allowing the ink to pass. Alternatively, for the elastic layer 2, use may be made of sponge rubber having continuous bubbles, felt, unwoven cloth of chemical fibers or metal fibers, polyvinyl acetal- or polyvinyl alcohol-based porous elastic substance having continuous bubbles, porous elastic substance consisting of hard grains and rubber and having continuous bubbles, porous elastic substance produced by sintering fine powder of polyethylene or similar synthetic resin, metal or inorganic substance, or porous elastic substance produced by fluid-sintering polyurethane or the like.

In the illustrative embodiment, as shown in FIG. 7, the elastic layer 2 is made up of two layers 2A and 2B. In the other figures, the layers 2A and 2B are simply represented by a single layer 2 in order to avoid complexity.

The master making device 500 includes a master support shaft 3*s* supporting a stencil roll 3*c* from which a stencil 3 is paid out. A thermal head 13 perforates the stencil 3, paid out from the roll 3*c*, by heat in accordance with image data. The thermal head 13 and a platen roller 12 are the major components of master making means. Guillotine type cutting means 14 is located downstream of the platen roller 12 with respect to the direction of conveyance of the stencil 3. The cutting means 14 consists of a movable edge and a stationary edge for cutting the stencil 3 at a predetermined length.

The platen roller 12 is mounted on a shaft 12*s* which is journalled to the opposite side walls of the printer, not shown. A stepping motor, not shown, is mounted on one of the side walls and rotates the shaft 12*s*. The thermal head 13 extends in parallel to the shaft 12*s* and is movable toward and away from the platen roller 12 with the intermediary of the stencil 3. The head 13 selectively perforates the stencil 3 by heat in accordance with a digital image signal in a conventional manner. The digital image signal is fed from an image processing circuit, not shown, which is connected to the CCD image sensor 31. The movable edge of the cutting means 14 is raised and lowered by a conventional elevating mechanism having a rack supporting the edge, a pinion meshed with the rack and journalled to the side walls of the printer, and a motor affixed to one side wall of the printer and drivably connected to the pinion by a drive transmitting member.

A tension roller pair 15 and a conveyor roller pair 16 are located downstream of the cutting means 14 and convey the stencil, or master, 3 perforated by the master making means toward the clamping means of the drum 100.

As shown in FIG. 7, the stencil 3 has a laminate structure made up of an extremely thin master film 3*a* made of polyester or similar thermoplastic resin, and a porous substrate 3*b* supporting the film 3*a*. The porous substrate 3*b* is comprised of a porous thin sheet of kozo, mitsumata, Manila hemp, flax or similar natural fibers, or non-woven cloth consisting of natural fibers and chemical fibers. The ink is held and scattered by the fibers of the substrate 3*b*.

As shown in FIG. 6, the clamping means has a stage extending along the axis of the drum 100, and a damper 18 facing the stage and rotatably supported by a damper shaft 17.

The drum 100 has thereinside an ink roller 4, a doctor roller 5, and the ink supply shaft 23. The ink roller 4 supplies ink to the inner periphery of the drum 100. The doctor roller 5 is parallel to and spaced apart from the ink roller 4 by a small gap A, thereby forming an ink well 6. The ink supply shaft 23 supplies ink to the ink well 6. The ink is fed under pressure from an ink pack, not shown, located at a suitable position by an ink pump, not shown. The ink is delivered to the ink well 6 via the ink supply shaft 23. Ink measuring means, not shown, measures the amount of the ink being supplied to the ink well 6. As a result, the supply of ink by the ink pump is controlled in amount. In the embodiment, a gap is also formed between the support layer 1 of the drum 100 and the ink roller 4 and filled with the ink.

The ink roller 4, made of aluminum or similar metal or rubber, is rotated clockwise, as viewed in FIG. 6, together with the drum 100 by a gearing, not shown. A predetermined ratio in peripheral speed is set up between the ink roller 4 and the drum 100. The doctor roller 5 is made of iron, stainless steel or similar metal and rotatable counterclockwise. A predetermined ratio in peripheral speed is also set up between the doctor roller 5 and the drum 100.

As shown in FIG. 6, the press roller 7 is positioned below and in close proximity to the drum 100. When the paper 8 is fed from the paper feeding device 600, the press roller 7 presses it against the drum 100. The press roller 7 is formed of rubber and rotatably supported by one end of a pair of arms 47 (only one is visible). Rotating means, not shown, causes the arms 47 to rotate about a shaft 47*a* in a pivotal motion. This causes the press roller 7 to move into and out of contact with the drum 100. When the press roller 7 is brought into contact with the drum 100 via the paper 8, it is rotated by and at the same peripheral speed as the drum 100.

Figure 8A:
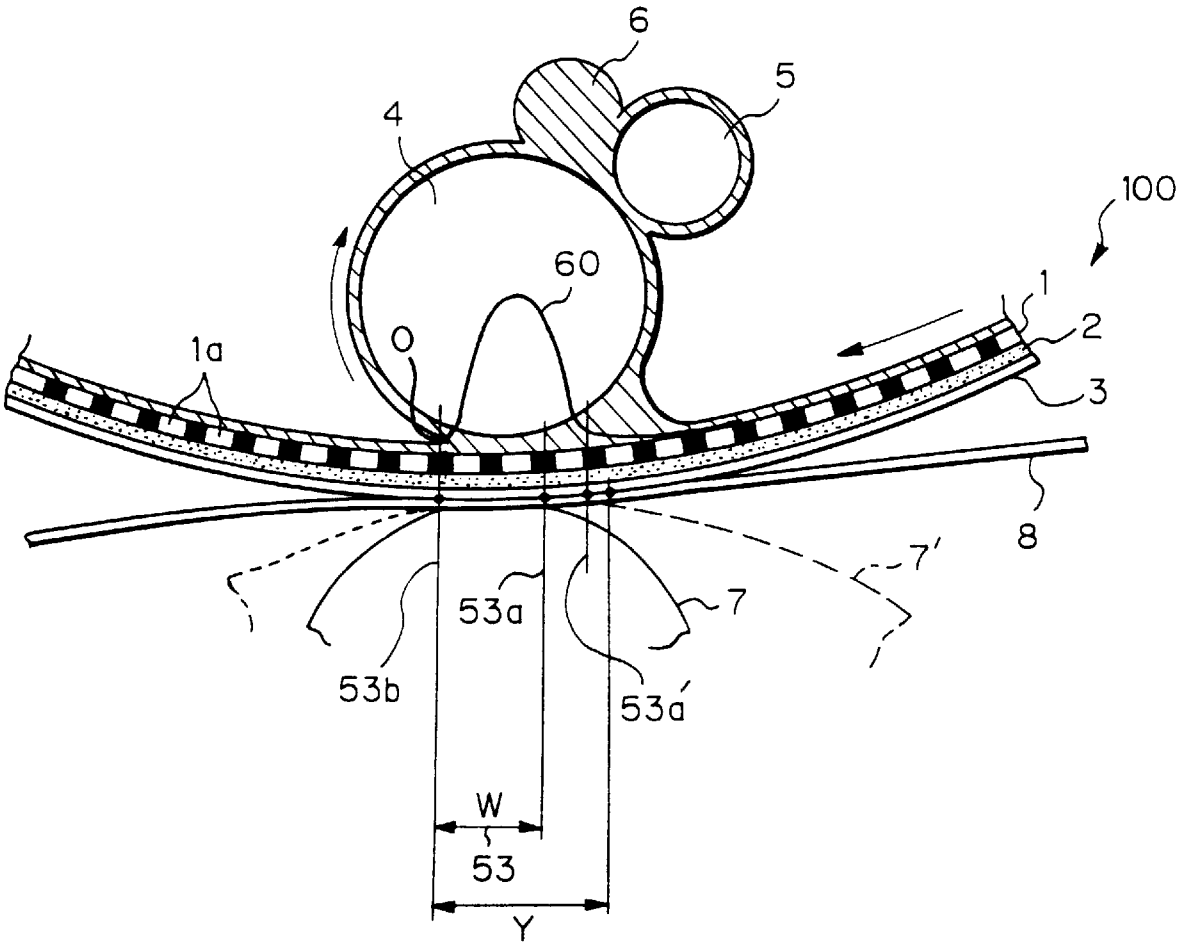
FIG. 8A is a section indicative of a portion where ink exudes from a master due to the wedge effect, and a pressing range.
Figure 8B:
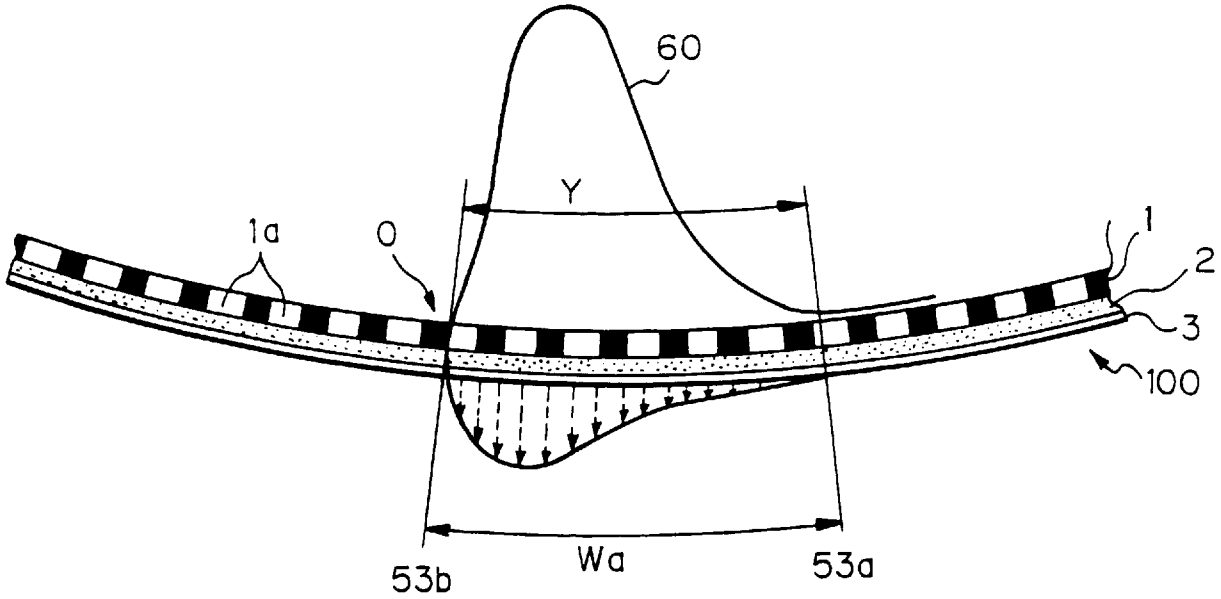
FIG. 8B shows a relation between the ink pressure distribution due to the wedge effect and the direction and size of exudation.

A reference will be made to FIGS. 8A and 8B for describing a portion Y where the ink exudes from the master 3 due to the wedge effect. The following experiments were conducted by using a stencil printer (PRIPORT VT-3500 available from Ricoh (Japan)). As shown in FIG. 8A, the pressing range 53 of the press roller 7 had its downstream end 53*b* in the direction of rotation of the drum 100 defined at a position ($X_0$, FIG. 2; determined by the Eq. (3)) matching the point O where the ink pressure due to the wedge effect becomes zero, i.e., where the ink did not exude. At the same time, the press roller 7 was replaced with a press roller 7' having a greater outside diameter in order to change the upstream end 53*a* of the pressing range 53 in the above-mentioned direction. How the ink transferred to the paper 8 runs was examined. As shown in FIG. 8B, the upstream end 53*a* of the pressing range 53 under a condition wherein the ink did not run on the paper 8 was determined. A zone corresponding to the width Wa of such a pressing range was determined to be the exuding portion Y. In FIG. 8B, dotted arrows indicate the direction in which the ink exudes, and each represents a particular size of exudation. The ink roller 4, paper 8 and press roller 7 are not shown in FIG. 8B in order to clearly indicate the relation between the pressure distribution 60 due to the wedge effect and the direction and size of exudation.

It should be noted that the words "downstream with respect to the direction of rotation of the drum 100" and the words "upstream with respect to the direction of rotation of the drum 100" include the downstream end and the upstream end, respectively.

Figure 9:
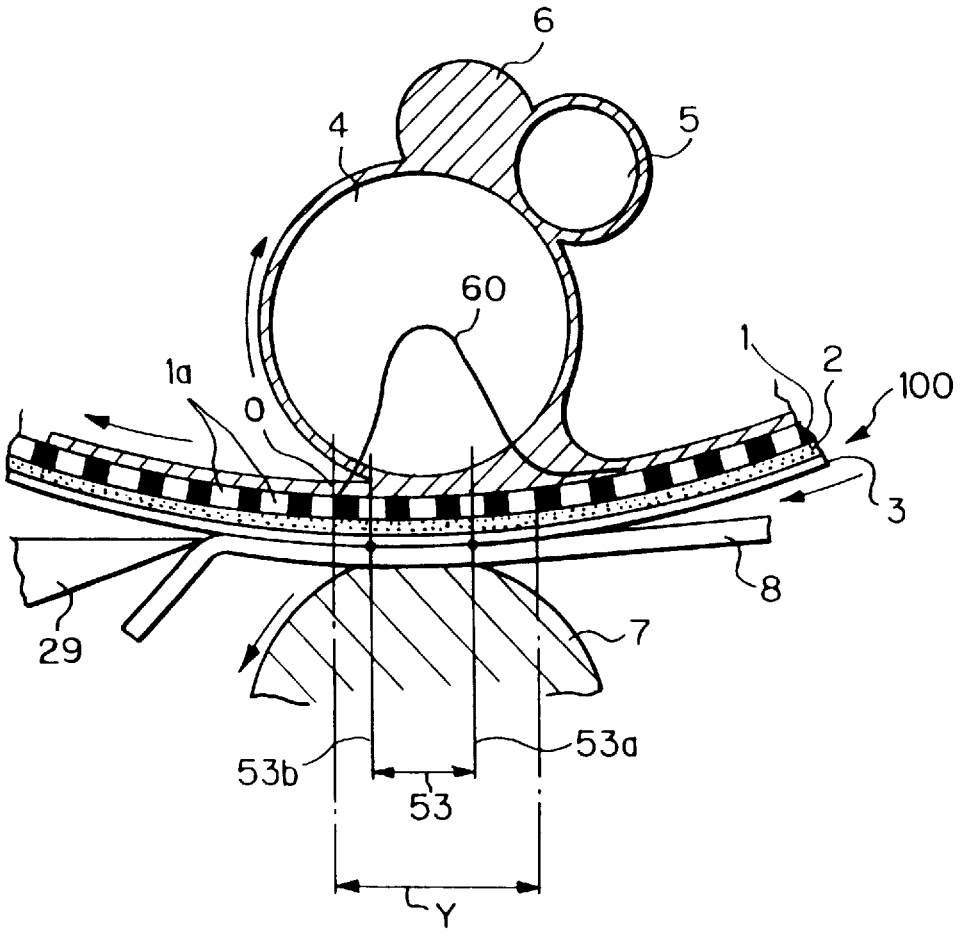
FIG. 9 is a fragmentary section of the first embodiment.

As shown in FIGS. 6 and 9, the separator 29 is located downstream of the exuding portion Y with respect to the direction of rotation of the drum 100. Hence, the paper 8 is separated from the master 3 at a position downstream of the exuding portion Y with respect to the above-mentioned direction. If desired, the paper 8 may be separated at the downstream end of the exuding portion Y where the ink pressure due to the wedge effect becomes zero. Air fed under pressure from a pump, not shown, is blown out from the end of the separator 29 toward the leading edge of the paper 8 at a high rate. This promotes the separation of the paper 8 from the master 3.

As shown in FIG. 6, the paper feeding device 600 has a paper tray 24, a pick-up roller 25, a separator roller pair 26, and a registration roller pair 27. The tray 24 is loaded with a stack of papers 8 and supported by the body of the paper feeding device in such a manner as to be movable up and down. Specifically, the tray 24 is raised or lowered in association with the amount of papers remaining thereon. The pick-up roller 25 and separator roller pair 26 are so positioned as to rest on the uppermost paper 8, and each is rotated by respective drive means, not shown. The registration roller pair 27 is positioned downstream of the separator roller pair 26 with respect to the direction of paper feed. The registration roller pair 27 once catches the leading edge of the paper 8 fed thereto and then drives it to between the drum 100 and the press roller 7 at a predetermined timing.

The paper discharging device 800 has a drive roller 38, a driven roller 37, a belt 39, a fan 28, and a tray 30. The drive roller 38 and driven roller 37 are each journalled to the opposite side walls of the body of the paper discharging device. The belt 39 is passed over the two rollers 37 and 38 and formed with a plurality of perforations. The drive roller 38 is driven by drive means, not shown, and in turn drives the driven roller 37 via the belt 39. The fan 28 is positioned between the opposite runs of the belt 39, i.e., between the rollers 37 and 38. The fan 28 in rotation generates a stream of air directed downward, so that the paper 8 is sucked onto the belt 39. The tray 30 for stacking the papers or printings 8 is positioned downstream of the drive roller 38 with respect to the direction of paper conveyance.

The master discharging device 700 has an upper discharging member 42, a lower discharging member 43, a collecting box 22, and a compressing plate 21. The upper discharging member 42 is made up of a drive roller 19 connected to drive means, not shown, a driven roller 20, and a rubber belt 41 passed over the rollers 19 and 20. Likewise, the lower discharging member 43 is made up of a drive roller 45 connected to drive means, not shown, a driven roller 44, and a rubber belt 46 passed over the rollers 45 and 44. Moving means, not shown, is capable of moving the lower discharge member 43 about the axis of the drive roller 19 in the right-and-left direction as viewed in the figure. Hence, the drive roller 45 is movable toward and away from the drum 100. The compressing plate 21, disposed above the collecting box 22, is moved up and down by elevating means, not shown.

In operation, the operator of the printer stacks documents 11 on the A DF 40 and then presses a master start button. In response, the master discharging device 700 discharges the used master 3 existing on the drum 100. Specifically, the drum 100, carrying the used master 3 thereon, is rotated counterclockwise by the previously mentioned motor. As soon as the trailing edge of the master 3 on the drum 100 arrives at a predetermined position where it faces the drive roller 45, the moving means and drive means, not shown, rotate the drive roller 45 and move the lower discharge member 43 toward the drum 100. At the time when the drive roller 45 contacts the drum 100, the drum 100 is rotating counterclockwise. As a result, the drive roller 45 picks up the trailing edge of the master 3. The upper and lower discharging members 42 and 43 nip the master 3 and separate it from the drum 100. The master 3 separated from the drum 100 is conveyed by the cooperative discharging members 42 and 43, collected in the box 22, and then compressed by the plate 21.

After the used master 3 has been fully separated from the drum 100, the drum 100 is further rotated and is brought to a stop when the damper 18 arrives at a master feed position adjoining the roller pair 16. Then, opening and closing means is operated to rotate the damper 18 clockwise, i.e., to open it. In this condition, the drum 100 waits for a new master.

Soon after the beginning of the master discharging procedure described above, a master making procedure begins. Specifically, one document 11 is conveyed from the stacking position to the reading position by the ADF 40, and then illuminated by the lamp 35. The resulting reflection from the document 11 is sequentially reflected by the mirrors 32 and 33 and then incident to the CC)D image sensor 31 via the lens 34. The image sensor 31 transforms the incident light to a corresponding electric signal. The electric signal is applied to the image processing circuit, not shown, and processed thereby to turn out a digital image signal. The document 11 read by the document reading section 200 is driven out to the document tray.

The thermal head 13 has a plurality of heating elements. The heating elements are selectively energized in accordance with the digital image signal. At the same time, the platen roller 12, tension roller pair 15 and conveyor roller pair 16 are rotated by the respective drive means. In this condition, the stencil 3 paid out form the roll 3*c* is perforated by the head 13 while being conveyed by the platen roller 12. The roller pair 16 drives the stencil 3 toward the outer periphery of the drum 100, i.e., the damper 18 held in the open position. When the stepping motor reaches a predetermined number of steps, it is determined that the leading edge of the perforated stencil, or master, 3 has reached the position between the open damper 18 and the stage. Then, the damper 18 is closed by the opening and closing means. At the same time, the drum 100 is rotated clockwise to wrap the master 3 therearound.

When the master 3 is wrapped around the drum 100 over a predetermined length, the drum 100, tension roller pair 15, platen roller 12 and conveyor roller pair 16 are brought to a stop. At the same time, the movable edge of the cutting means 14 is lowered by the elevating means to cut the master 3 in cooperation with the underlying stationary edge. Then, the drum 100 is again rotated clockwise until the leading edge of the cut master 3 leaves the master making device 500. In this manner, the master 3 is fully wrapped around the drum 100.

After the master feed procedure described above, the drum 100 is rotated clockwise by the motor. The uppermost paper 8 stacked on the tray 24 is fed by the pick-up roller 25 and separated from the underlying papers by the separator roller pair 26. The paper 8 is driven toward the registration roller pair 27 along a guide. The registration roller pair 27 conveys the paper 8 to between the press roller 7 and the drum 100 at a predetermined timing.

The press roller 7 is moved by the rotating means to press the drum 100, master 3 and paper 8 between it and the ink roller 4. At this instant, the ink is measured at the gap A between the ink roller 4 and the doctor roller 5 and then fed to the inner periphery of the support layer 1. The ink exudes to the elastic layer 2 and further to the porous substrate 3*b* of the master 3 due to the wedge effect acting between the ink roller 4 and the support layer 1 which are in rotation. Consequently, the ink is transferred from the drum 100 to the paper 8 via the perforations of the master film 3*a*, thereby forming an image on the paper 8.

At the position downstream of the exuding portion Y with respect to the direction of rotation of the drum 100, the separator 29 separates the paper or printing 8 carrying the image thereon from the master 3. The printing 8 is received by the belt 39 located below the separator 29. The belt 39, driven by the drive roller 38, conveys the printing 8 while retaining it thereon due to the suction of the fan 28. Finally, the printing 8 is driven out to the tray 30 as a trial printing. Subsequently, the operator enters printing conditions, including a desired number of printings, and then presses a print start switch. In response, the print drum 100 is rotated by the motor while papers 8 are sequentially delivered toward the drum 100.

As stated above, the embodiment separates the printing 8 from the master 3 at a position downstream of the exuding portion Y, where the ink exudes due to the wedge effect, with respect to the direction of rotation of the drum 100, i.e., at a position where the ink pressure does not act. This successfully prevents the ink from being transferred to the front of the paper 8 in an excessive amount which would smear the rear of the overlying paper, as described earlier.

Figure 10:
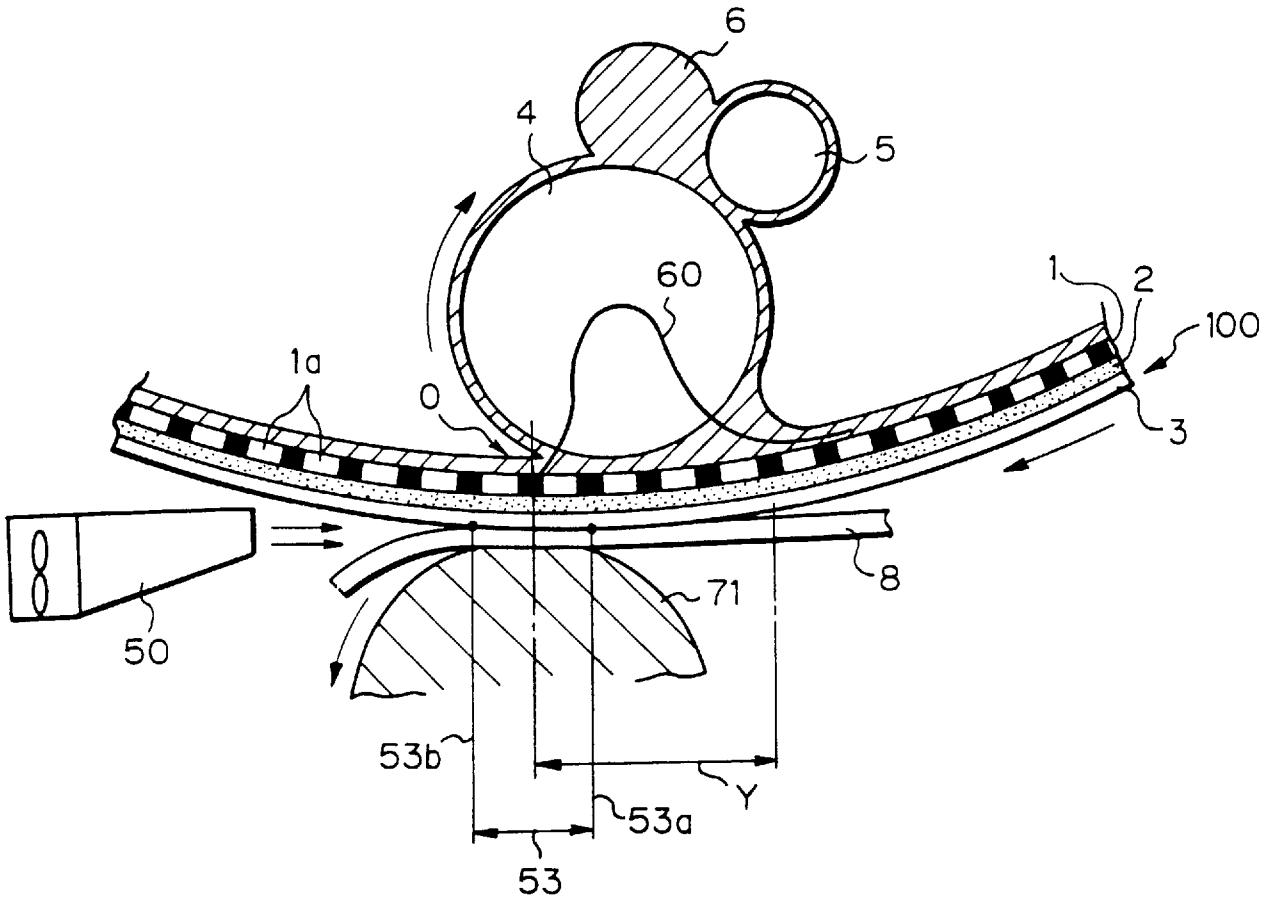
FIG. 10 is a section showing a second embodiment of the present invention.

Referring to FIG. 10, a second embodiment of the present invention will be described which is essentially similar to the first embodiment except for the following. As shown, a press roller 71 is positioned such that the upstream end 53*a* of the pressing range 53 with respect to the direction of rotation of the drum 100 is positioned in the exuding portion Y, and such that the downstream end 53*b* of the pressing range 53 is positioned downstream of the exuding position Y. The separator 29 of the previous embodiment is replaced with a blower 50. The blower 50, playing the role of the means for separating the paper 8 from the master 3, is positioned downstream of the drum 100 and blows air toward the separating position where the paper 8 should be separated from the drum 100. The separating position is located downstream of the oozing position Y, as in the first embodiment. The words "upstream" and "downstream" will be used with respect to the direction of rotation of the drum 100, except for some exceptional cases.

In the illustrative embodiment, the press roller 71 presses the paper 8 against the master 3 at part of the exuding portion Y derived from the wedge effect. The press roller 71 presses the paper 8 up to a position downstream of the exuding portion Y and where the ink does not exude. As a result, the paper 8 is separated from the master 3 at the position where the ink does not ooze out. This, coupled with the fact that the ink pressure does not act at such a position, prevents the ink from being deposited on the front of the paper 8 in an excessive amount, thereby eliminating the transfer of the ink to the rear of the overlying paper.

The blower 50 is used to ensure the separation of the paper 8 from the master 3. However, because the ink does not exude at the paper separating position, the blower 50 is omissible if the paper 8 can be separated from the master 3 due to its own elasticity, e.g., when the paper 8 is relatively thick. If desired, the downstream end 53*b* of the pressing range 53 may be located downstream of the exuding portion Y, and the upstream end 53*a* may be coincident with the upstream end of the exuding portion Y. Furthermore, the downstream end 53*b* may be coincident with the downstream end of the exuding portion Y. In addition, the paper separating position may be coincident with the downstream end of the exuding portion Y, i.e., the point O where the ink pressure derived from the wedge effect becomes zero.

Figure 11:
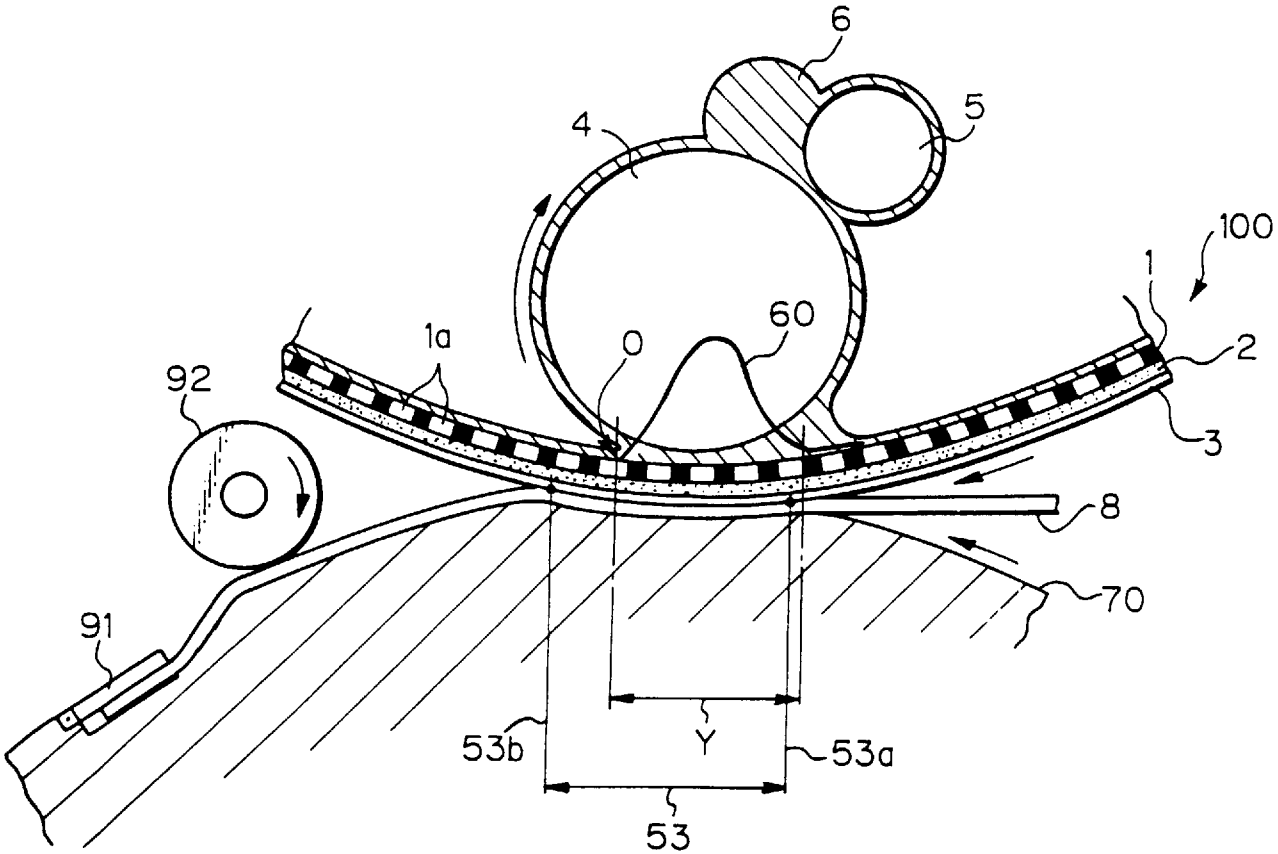
FIG. 11 is a fragmentary section showing a modification of the second embodiment.

FIG. 11 shows a modification of the second embodiment. The modification differs from the second embodiment in that a press drum 70 is substituted for the press roller 71. The press drum 70 has the same diameter as the print drum 100 and is angularly moved up and down by means, not shown. A paper damper 91 and a pair of paper discharge rollers 92 (only one is visible) are provided on the press drum 70. The paper damper 91 clamps the leading edge of the paper 8 while the paper discharge rollers 92 press the opposite nonimage portions of the paper 8. Means, not shown, causes the paper damper 91 to release the leading edge of the paper 8 at a position downstream of the exuding portion Y.

The paper discharge rollers 92 are constantly pressed against the press drum 70 by a spring or similar biasing means and rotated by the drum 70. During the course of printing, the leading edge of the paper 8 is clamped by the paper damper 91, so that the paper 8 can be separated from the master 3 without wrapping around the drum 100. However, if the printing is under way when the damper 91 has released the leading edge of the paper 8, it is likely that the portion of the paper 8 undergoing printing adheres to the print drum 100 and prevents the paper 8 from being separated at an adequate position. In the light of this, the paper discharge rollers 92 press the paper 8 against the press drum 70 so that the paper 8 is separated at the adequate position. The press drum 70 is positioned such that the upstream end 53*a* and the downstream end 53*b* of the pressing range 53 are respectively located upstream and downstream of the pressing range 53.

In the modification, the press drum 70 presses the paper 8 against the master 3 within part of the exuding portion Y derived from the wedge effect. The paper 8 is released from the master 3 at the position downstream of the exuding portion Y and where the ink does not exude. Further, the press drum 70 presses the paper 8 against the master 3 up to the position downstream of the exuding portion Y and where the ink does not exude and the ink pressure is zero. This prevents the ink from being transferred to the front of the paper 8 in an excessive amount which would smear the rear of the overlying paper.

In the first and second embodiments and the modification of the second embodiment, the upstream end 53*a* of the pressing range 53 is naturally defined at an upstream position determined by the width W of the pressing range 53.

Figure 12:
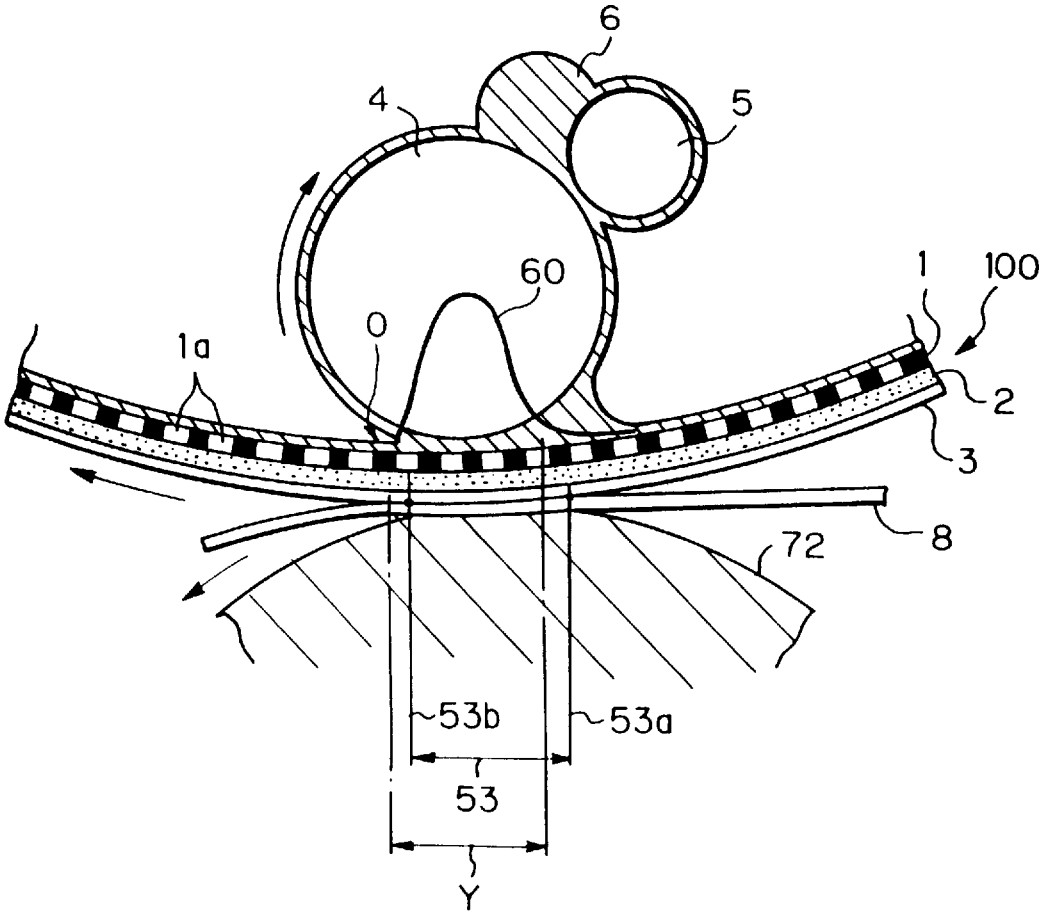
FIG. 12 is a fragmentary section showing a third embodiment of the present invention.

Referring to FIG. 12, a third embodiment of the present invention will be described. To better understand this embodiment, a relation between the pressing range 53 and the blur of a printed image will be described with reference to FIG. 8A. We conducted the following experiments by using the stencil printer (PRIPORT VT-3500 available from Ricoh (Japan)). The pressing range 53 of the press roller 7 had its downstream end 53*b* with respect to the direction of rotation of the drum 100 defined at a position ($X_0$, FIG. 2; determined by the Eq. (3)) matching the point O where the ink pressure due to the wedge effect becomes zero, i.e., where the ink did not exude. At the same time, the press roller 7 was replaced with a press roller 7' having a greater outside diameter in order to change the upstream end 53*a* of the pressing range 53 in the above-mentioned direction. Assuming that the pressing range 53 had a width W (mm), the width W and how the ink transferred to the paper 8 runs were observed. The results of the experiments are listed in Table 1 below.

TABLE 1

| WIDTH W (mm) | RUNNING |
|---|---|
| 2 | x |
| 3 | x |
| 4 | Δ |
| 5 | ○ |
| 6 | ◎ |
| 7 | ◎ |
| 8 | ◎ |
| 9 | ◎ |
| 10 | ◎ |
| 11 | ○ |
| 12 | ○ |
| 13 | Δ |
| 14 | Δ |
| 15 | x |
| 16 | x |

In Table 1, crosses, triangles, circles and double circles respectively indicate much running, slight running, little running, and no running.

As Table 1 indicates, the ink runs little if the width W is 5 mm, or 12 mm and does not run if it is 6 mm to 10 mm. When the width W is 13 mm or above, the width W extends to an excessive degree at the upstream side with respect to the direction of rotation of the drum 100 for the following reasons. In the range whose width W is 13 mm or above, the ink pressure high enough for the ink to ooze out does not act. However, because the paper 8 and master 3 contact each other, the ink contained in the porous substrate 3*b* of the master 3 is absorbed by the paper 8 due to the capillary action of the fibers of the paper 8. Further, when the paper 8 is passed through the exuding portion Y, the ink exudes from the master 3 and deposits on the paper 8 in an excessive amount. The excess ink penetrates the paper 8 in the thicknesswise direction and even approaches the rear of the paper 8. This kind of occurrence is undesirable when, for example, an image should be printed on both sides of the paper 8.

It will be seen from the above that when the upstream end 53*a* of the pressing range 53 is located at an upstream point 5 mm away from the the point O where the ink pressure due to the wedge effect becomes zero, the ink is substantially prevented from exuding. Therefore, the upstream end of the exuding portion Y coincides with the above-mentioned upstream point. It follows that the width W of the pressing range 53 should preferably be 5 mm or above, but less than 13 mm, more preferably 6 mm or above, but less than 11 mm.

The third embodiment is essentially similar to the first embodiment except that the downstream end 53*b* of the pressing range 53 is located at the exuding portion Y while the upstream end 53*a* is located at a point upstream of the portion Y.

In the third embodiment, the press roller 72 presses the paper 8 against the master 3 from a point upstream of the exuding portion Y and where the ink substantially does not exude. Then, the ink immediately penetrates the paper 8 in the thicknesswise direction in the exuding portion Y. As a result, a printing free from blur is achievable.

If desired, the upstream end 53a of the pressing range 53 may be located upstream of the exuding portion Y, and the downstream end 53*b* may be coincident with the downstream end of the portion Y. Further, the upstream end 53*a* may even be coincident with the upstream end of the exuding portion Y. In the illustrative embodiment, the downstream end 53*b* is naturally defined at a downstream position determined by the width W of the pressing range 53.

Figure 13:
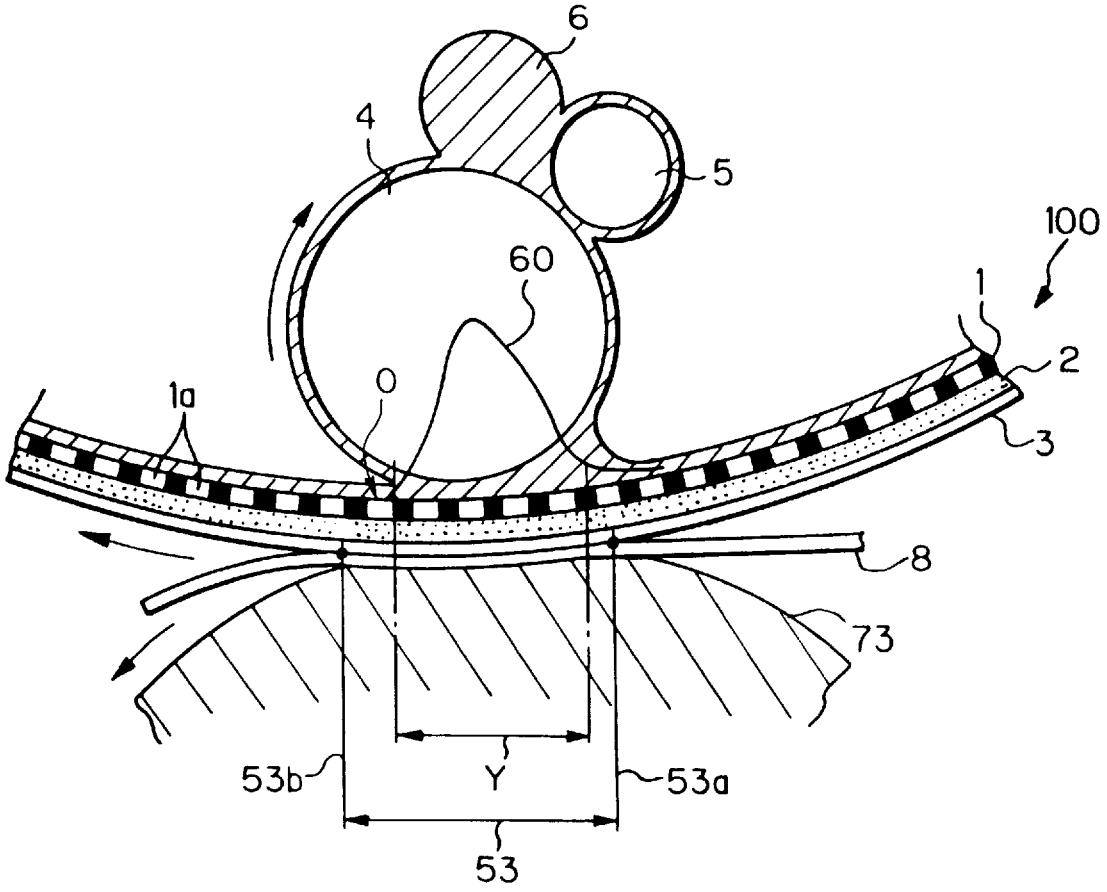
FIG. 13 is a fragmentary section showing a fourth embodiment of the present invention.

A fourth embodiment of the present invention will be described with reference to FIG. 13. This embodiment i s similar to the first embodiment except that a press roller 73 is so arranged as to contain the entire exuding portion Y in the pressing range 53, and in that the separator 29 is omitted. In this embodiment, the press roller 73 presses the paper 8 against the master 3 from a point upstream of the exuding portion Y and where the ink substantially does not exude to a point downstream of the portion Y and where the ink does not exude. In addition, the paper 8 is separated from the master 3 at a point downstream of the downstream end 53*b* of the pressing range 53. This ensures printings free from blur and obviates the transfer of the ink to the rear of the overlying printing. Moreover, because the paper 8 is continuously pressed against the master 3 while the wedge effect acts, it is possible to take full advantage of the exudation of the ink due to the wedge effect and, therefore, to produce images of high density.

If desired, the upstream end 53*a* and the downstream end 53*b* of the pressing range 53 may be respectively located at the upstream end and the downstream end of the exuding portion Y. Further, the separating position assigned to the paper 8 may coincide with the downstream end of the exuding portion Y, i.e., the point O where the ink pressure due to the wedge effect becomes zero.

This embodiment defines the paper separating position at the position where the ink does not ooze out, and lacks the means for separating the paper 8 from the master 3 on the basis of the elasticity of the paper 8. However, the separator 29 or the blower 50 may be used to ensure the separation of the paper 8, if desired.

In the embodiments shown and described, the porous support layer 1 has a radius Ro which is sufficiently greater than the thicknesses of the support layer 1, elastic layer 2, and master 3. Hence, the ink pressure distribution and exuding portion Y derived from the wedge effect, and pressing range 53 may, of course, have their positional relation indicated on a single line. However, to better understand the relation, the embodiments indicate them at the relating positions, i.e., indicate the ink pressure distribution along the inner periphery of the drum 100 while indicating the exuding portion Y and pressing range 53 along the outer periphery of the master 3.

The drum 100 has been shown and described as having the porous support layer 1 and porous elastic layer 2. Alternatively, the drum 100 may be implemented only by the cylindrical porous elastic layer 2, as taught in, for example, Japanese Patent Laid-Open Publication Nos. 1-204781 (corresponding U.S. Pat. No. 4,911,069) and 59-218889.

In the foregoing embodiments and modification, the master 3 is made up of the master film 3*a* made of thermoplastic resin, and the porous substrate 3*b* adhered to the film 3*a*. Alternatively, the master 3 may be implemented substantially only by the film of thermoplastic resin. It should be noted that a master implemented substantially only by a film of thermoplastic resin even covers a thermoplastic resin film containing a trace of antistatic agent or the like, and a thermoplastic resin film carrying one or more antistick layers or similar layers on at least one side thereof.

When the master has the porous substrate 3*b* which serves as a porous elastic layer, use may be made of a print drum not having the porous elastic layer 2, and the master 3 may be wrapped around the print drum such that the substrate 3*b* contacts the support layer 1. When the micropores of the support layer 1 have a sufficiently small diameter and pitch, there may be used a print drum not having the elastic layer 2. In such a case, the master having both the master film 3*a* and the substrate 3*b* or a master implemented substantially only by a thermoplastic resin film will be wrapped around the support layer 1 of the print drum.

In summary, in accordance with the present invention, ink is caused to exude from the inner periphery to the outer periphery of a print drum and further from a master due to the pressure of a pressing member and a wedge effect which occurs between an ink roller and the inner periphery of the print drum. A paper is separated from the master at a position downstream, with respect to the direction of rotation of the print drum, of a portion where the ink exudes from the master due to the wedge effect. At the paper separating position, the ink does not exude, and the ink pressure does not act. This successfully prevents excess ink from depositing on the front of a paper and thereby frees the rear of the overlying paper from smears.

The pressing member presses the paper against the master from the position where the ink exudes to a position downstream of the exuding portion and where the ink does not exude and the ink pressure does not act. This also prevents excess ink from depositing on the front of the paper. Specifically, even when the paper separating position changes due to the resiliency of a paper and the presence/absence of an image, the paper is surely separated from the master at a position where the ink does not exude due to the function of the pressing member. This frees the rear of the overlying paper from smears.

The pressing member presses the paper from the position where the ink does not exude from the master, i.e., where the ink pressure high enough for the ink to exude does not act. At the exuding position, the ink exudes and immediately penetrates the paper in the thicknesswise direction. The resulting printing is free from blur. This is not attainable with the conventional procedure wherein a paper is pressed against a master after ink has exuded from a oozing portion.

The pressing range of the pressing member extends from a point upstream of the exuding portion to a position downstream of the same. Hence, the paper is pressed against the master from a position upstream of the exuding portion and where the ink substantially does not exude, i.e., the ink pressure high enough for the ink to exude does not act to a position downstream of the exuding position and where the ink does not exude, i.e., the ink pressure does not act. This also frees a printing from blur and obviates the transfer of ink to the rear of the overlying paper. Because the paper is pressed against the master while the wedge effect acts, it is possible to take full advantage of the exudation of the ink derived from the wedge effect and to produce images of high density.

Further, the present invention eliminates the need for a porous support layer and thereby simplifies the configuration of the print drum while reducing the cost. The ink is uniformly scattered in the porous elastic layer, freeing images from irregularity.

In addition, use is made of a porous support layer substantially made of a rigid material. Hence, when the pressing member exerts a pressure on the print drum, the drum is prevented from deforming. In this condition, the wedge-like gap between the print drum and the ink roller remains stable and ensures a sufficient wedge effect. Specifically, the width of the exuding portion is stabilized and allows the pressing range for reducing the contamination of the rear of a sheet and blur to be set up with ease. The porous elastic layer causes the ink from the porous support layer to be uniformly scattered, thereby freeing images from irregularity.

Various modifications will become possible for those skilled in the art after receiving the teachings of the present disclosure without departing from the scope thereof.

What is claimed is:

1. A method of printing a document image on a paper by causing ink to exude through a master having a perforation pattern which is representative of said document image, said method comprising the steps of:

wrapping the master around an outer periphery of a print drum;

supplying the ink to an inner periphery of said print drum by an ink roller;

pressing the paper against the master by a pressing member;

transferring the ink to the paper by causing said ink to exude from the master due to a wedge effect which occurs between said ink roller and said inner periphery of said print drum such that a downstream end of a pressing range of said pressing member with respect to a direction of rotation of said print drum is located downstream, with respect to said direction, and an upstream end of the pressing range of said pressing member with respect to the direction of rotation of said print drum is located upstream with respect to said direction, of a portion where said ink exudes from said master due to said wedge effect; and separating the paper from the master at a position downstream, with respect to the direction of rotation of said print drum, of the portion where the ink exudes from the master due to the wedge effect.

2. A method as claimed in claim 1, wherein said print drum comprises a cylindrical porous elastic layer.

3. A method as claimed in claim 1, wherein said print drum comprises a cylindrical porous support layer substantially made of a rigid material, and a porous elastic layer formed on said porous support layer.

4. A stencil printer for printing a document image on a paper by causing ink to exude through a master having a perforation pattern which is representative of said document image, said printer comprising:

a print drum for wrapping the master around an outer periphery thereof;

an ink roller for supplying the ink to an inner periphery of said print drum;

a pressing member for pressing the paper against the master, wherein the ink is transferred to the paper by being caused to exude from the master due to a wedge effect which occurs between said ink roller and said inner periphery of said print drum such that a downstream end of a pressing range of said pressing member with respect to a direction of rotation of said print drum is located downstream, with respect to said direction, and an upstream end of the pressing range of said pressing member with respect to the direction of rotation of said print drum is located upstream with respect to said direction, of a portion where said ink exudes from said master due to said wedge effect; and a separating member for separating the paper, carrying the ink thereon, from the master;

wherein said separating member is positioned downstream, with respect to the direction of rotation of said print drum, of the portion where the ink exudes from the master due to the wedge effect, and wherein a position for separating the paper from said master is located downstream of said portion with respect to said direction.

5. A printer as claimed in claim 4, wherein said print drum comprises a cylindrical porous elastic layer.

6. A printer as claimed in claim 4, wherein said print drum comprises a cylindrical porous support layer substantially made of a rigid member, and a porous elastic layer formed on said porous support layer.

7. A stencil printer for printing a document image on a paper by causing ink to exude through a master having a perforation pattern which is representative of said document image, said printer comprising:

a print drum for wrapping the master around an outer periphery thereof;

an ink roller for supplying the ink to an inner periphery of said print drum; and a pressing member for pressing the paper against the master;

wherein the ink is transferred to the paper by being caused to exude from the master due to a wedge effect which occurs between said ink roller and said inner periphery of said print drum, and wherein said pressing member is positioned such that a downstream end of a pressing range of said pressing member with respect to a direction of rotation of said print drum is located downstream, with respect to said direction, and an upstream end of the pressing range of said pressing member with respect to the direction of rotation of said print drum is located upstream with respect to said direction, of a portion where said ink exudes from said master due to said wedge effect.

8. A printer as claimed in claim 7, wherein said print drum comprises a cylindrical porous elastic layer.

9. A printer as claimed in claim 7, wherein said print drum comprises a cylindrical porous support layer substantially made of a rigid member, and a porous elastic layer formed on said porous support layer.

* * * * *

UNITED STATES PATENT AND TRADEMARK OFFICE

CERTIFICATE OF CORRECTION

PATENT NO. : 5,845,571

DATED : December 8, 1998

INVENTOR(S) : Michio KURASHIGE, et al.

It is certified that error appears in the above-identified patent and that said Letters Patent is hereby corrected as shown below:

Column 7, line 36 delete "damper" and insert --clamper--

Column 7, line 37 delete "damper" and insert --clamper--

Column 9, line 46 delete "damper" and insert --clamper--

Column 9, line 48 delete "damper" and insert --clamper--

Column 9, line 57 change "CC)D" to --CCD--

Column 10, line 5 delete "damper" and insert --clamper--

Column 10, line 9 delete "damper" and insert --clamper--

Column 10, line 10 delete "damper" and insert --clamper--

Column 11, line 44 delete "damper" and insert --clamper--

Column 11, line 55 delete "damper" and insert --clamper--

Column 11, line 57 delete "damper" and insert --clamper--

Column 11, line 46 delete "damper" and insert --clamper--

Column 11, line 49 delete "damper" and insert --clamper--

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*